US005119591A

United States Patent [19]

Sterner, Jr. et al.

[11] Patent Number: 5,119,591

[45] Date of Patent: Jun. 9, 1992

[54] VERTICALLY SLIDABLE WINDOW UNIT

[75] Inventors: Maurice E. Sterner, Jr., Spring Grove; Eugene F. Hickson, Butler, both of Pa.

[73] Assignee: Product Design & Development, Inc., York, Pa.

[21] Appl. No.: 733,639

[22] Filed: Jul. 22, 1991

[51] Int. Cl.[5] ..... E05D 15/22

[52] U.S. Cl. ..... 49/162; 49/178; 49/179; 49/422; 49/445

[58] Field of Search ..... 49/162, 177, 178, 179, 49/445, 414, 422

[56] References Cited

U.S. PATENT DOCUMENTS

| | | | |
|---|---|---|---|
| 2,104,860 | 1/1938 | Fuchsman | 49/177 X |
| 2,165,943 | 7/1939 | Schuler | 49/177 X |
| 2,921,349 | 1/1960 | Humphrey | 49/422 |
| 3,206,804 | 9/1965 | Perry | 49/422 X |
| 3,287,853 | 11/1966 | Silverman | 49/179 |
| 3,399,491 | 9/1968 | Dawidowicz | 49/162 X |
| 3,890,741 | 6/1975 | Johnson et al. | 49/162 |
| 3,981,101 | 9/1976 | Guzzi | 49/162 |
| 4,227,345 | 10/1980 | Durham, Jr. | 49/445 X |

*Primary Examiner*—Philip C. Kannan

*Attorney, Agent, or Firm*—Samuel M. Learned, Jr.

[57] ABSTRACT

An improved vertically slidable pivotal window unit having a spring loaded jamb latch assembly which provides a mechanically positive latching and release mechanism in going from the vertically displaceable to horizontally pivotal sash opening and closing modes.

5 Claims, 4 Drawing Sheets

Fig. 3
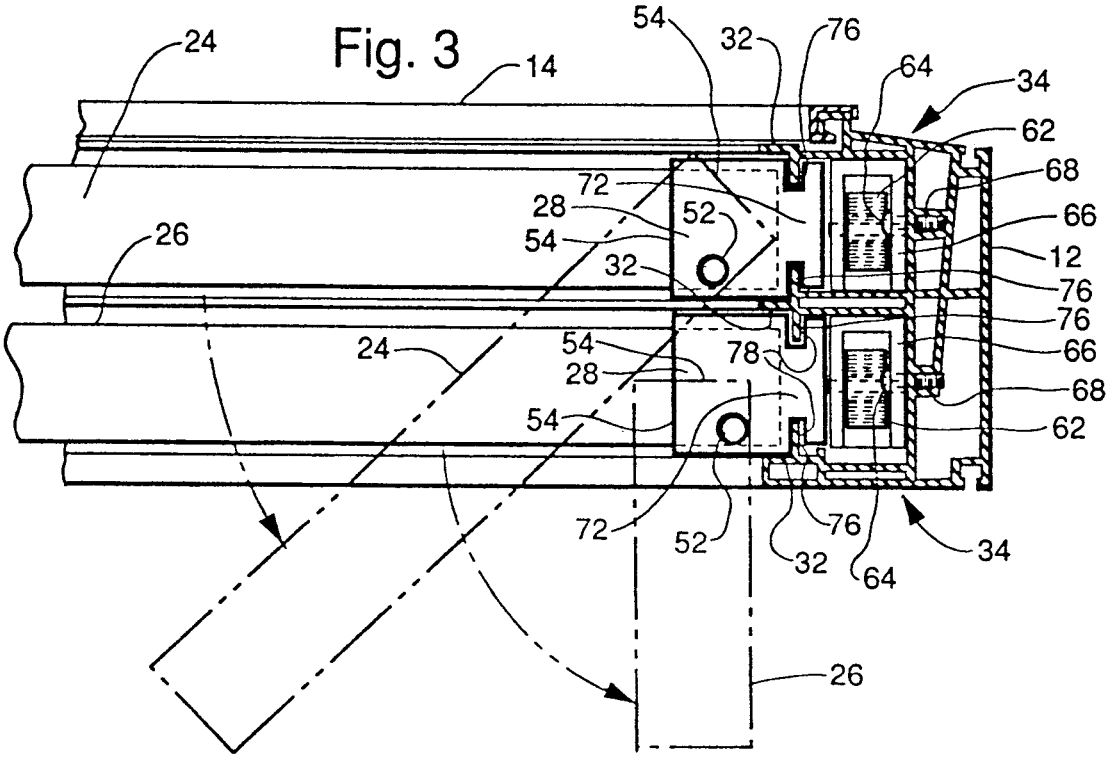
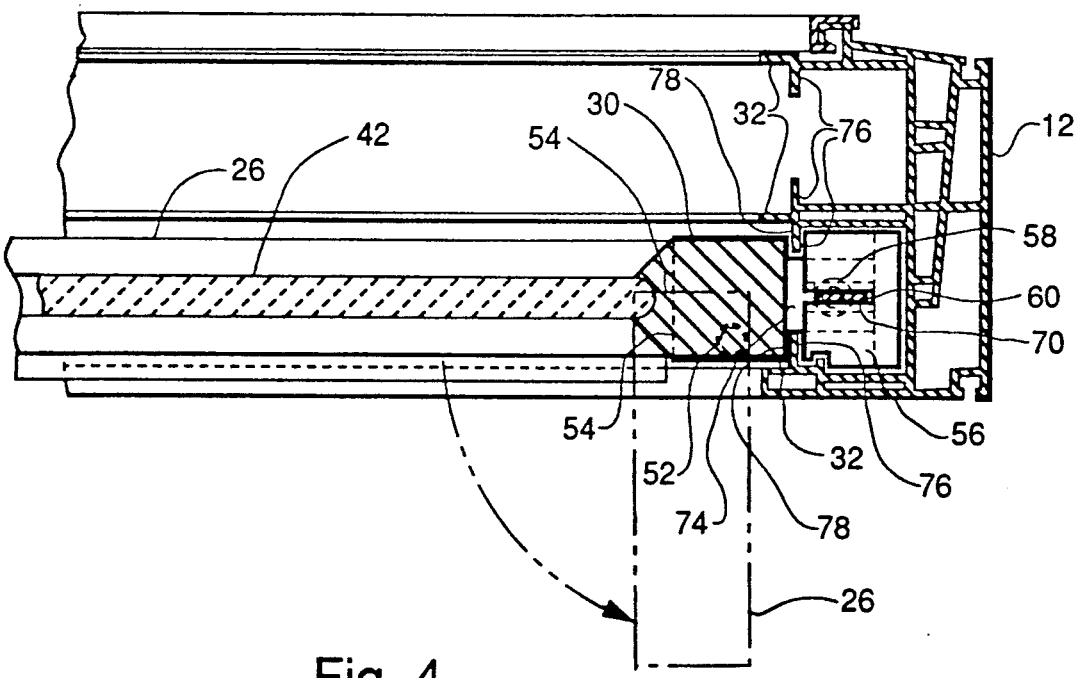
Fig, 4

VERTICALLY SLIDABLE WINDOW UNIT

BACKGROUND OF THE INVENTION

The present invention relates to a window unit structure having sashes which are both vertically displaceable as well as horizontally pivotal inwards, thereby enhancing the ease and safety with which one is enabled to not only clean but also perform routine maintenance upon the same.

The concept of double hung window constructions having sashes mounted within a frame assembly which provides for both vertically slidable and additionally either vertically or horizontally pivotal movement of the sashes for cleaning purposes is not per se new, and is well developed in the art as is typically exemplified respectively by U.S. Pat. No. 3,184,784 to Peters dated May 25, 1965, in the case of a vertically pivotal sash or tilt window construction as it is commonly called, and by U.S. Pat. No. 3,981,101 to Guzzi dated Sep. 21, 1976, in the case of a horizontally pivotal sash construction. Considerations with respect to such window constructions however, especially in the case of a tilt window, is first it is not self supporting when profiled in the tilt configuration for purposes of cleaning and second is that if the sash after being opened to a tilt configuration is not thereafter securely returned to a closed and latched configuration it may accidentally fall open on its own accord, or say be blown open by the wind, with the consequence that if someone were standing in front of the window in the circumstance of such an accidentally opened event, they may be impacted and injured by the pivotally falling sash.

A horizontally pivotal sash construction generally avoids the foregoing inconvenience and hazard, but none-the-less it is necessary for not only safety, but also for purposes of security, that a latching assembly for locking the horizontally pivotal sash to a vertically closed profile be both adequate and reliable. Examples of prior art teachings showing latching mechanisms for the horizontally swingable sashes of a window construction of the type presently under consideration would be as set forth in U.S. Pat. No. 2,104,860 to Fuchsman dated Jan. 11, 1938, as well as U.S. Pat. No. 2,165,943 to Schuler dated Jul. 11, 1939, and U.S. Pat. No. 3,890,741 to Johnson et al dated Jun. 24, 1975. In the foregoing teachings, either the mechanical facility with which a horizontally pivotal sash latch means may be released or engaged, or the durability thereof in withstanding repeated cycles of horizontally pivotal sash opening and closing, are limiting aspects of either or both the designs and structures respectively thereof.

The present invention is distinguished from the foregoing in that it approaches the vertically slidable pivotal window construction as a unitized concept in terms of overall cooperation of the various structural elements in achieving an efficient and safe design as hereinafter more specifically detailed and described.

SUMMARY OF THE INVENTION

It is the principal object of the present invention to provide an improved vertically slidable pivotal window unit which embodies a new and novel spring loaded jamb latch assembly whereby the window sashes thereof may be retained within the frame for vertical displacement, or alternately released along one vertical edge thereof for horizontally pivotal inward opening about the other vertical edge thereof.

It is another object of the present invention to provide an improved vertically slidable pivotal window unit having a spring loaded jamb latch structure which is mechanically positive in terms of the safety aspects thereof when effecting a latching and release of a window sash in going from the vertically displaceable to horizontally pivotal sash opening and closing modes.

An additional object of the present invention is to provide an improved vertically slidable pivotal window unit having a spring loaded jamb latch structure which when depressed and retainably engaged by the jamb latch and release keepers therefor simultaneously releases all sash members of said window unit for horizontally pivotal inward opening.

It is also an object of the present invention to provide an improved vertically slidable pivotal window unit having a simplified sash pivot means for enabling horizontal sash swinging.

An even further object of the present invention is to provide a vertically slidable pivotal window unit having vertically displaceable sashes with sash jamb frame guide followers that are captured within a jamb frame slot and therefore more efficient in reducing thermal leakage by providing an improved weather tight assembly.

Yet another object of the present invention is to provide a vertically slidable pivotal window unit which requires counterbalancing of the sashes at one side thereof only.

A further object of the present invention is to provide an improved vertically slidable pivotal window unit which enables both the vertically displaceable and horizontally swingable movement of either one or both the upper and lower sash while at any vertically displaced opened window position within the frame thereof.

Still another object of the present invention is to provide an improved vertically slidable window unit which enables inwardly horizontal swinging of the sashes so one may clean both the inside and outside panes therein from the safety and convenience of the inside of a structure.

Yet another object of the present invention is to provide an improved vertically slidable pivotal window unit which may be used as a replacement window to upgrade existing windows.

It is also an object of the present invention to provide an improved vertically slidable pivotal window unit having as additional features efficiency of design and simplicity of construction so as to reduce not only the initial cost thereof but also the ongoing maintenance requirements and costs associated therewith.

Details of the foregoing objects and of the invention, as well as other objects thereof, are set forth in the following specification and illustrated in the accompanying drawings comprising a part thereof.

BRIEF DESCRIPTION OF THE DRAWINGS

FIG. 3 is an enlarged top plan sectional view of the window unit assembly shown in FIG. 1 and seen along the line 3—3 thereof.

FIG. 4 is an enlarged top plan sectional view of the window unit assembly as shown in FIG. 1 and seen along the line 4—4 thereof.

DETAILED DESCRIPTION OF THE INVENTION

Figure 1:
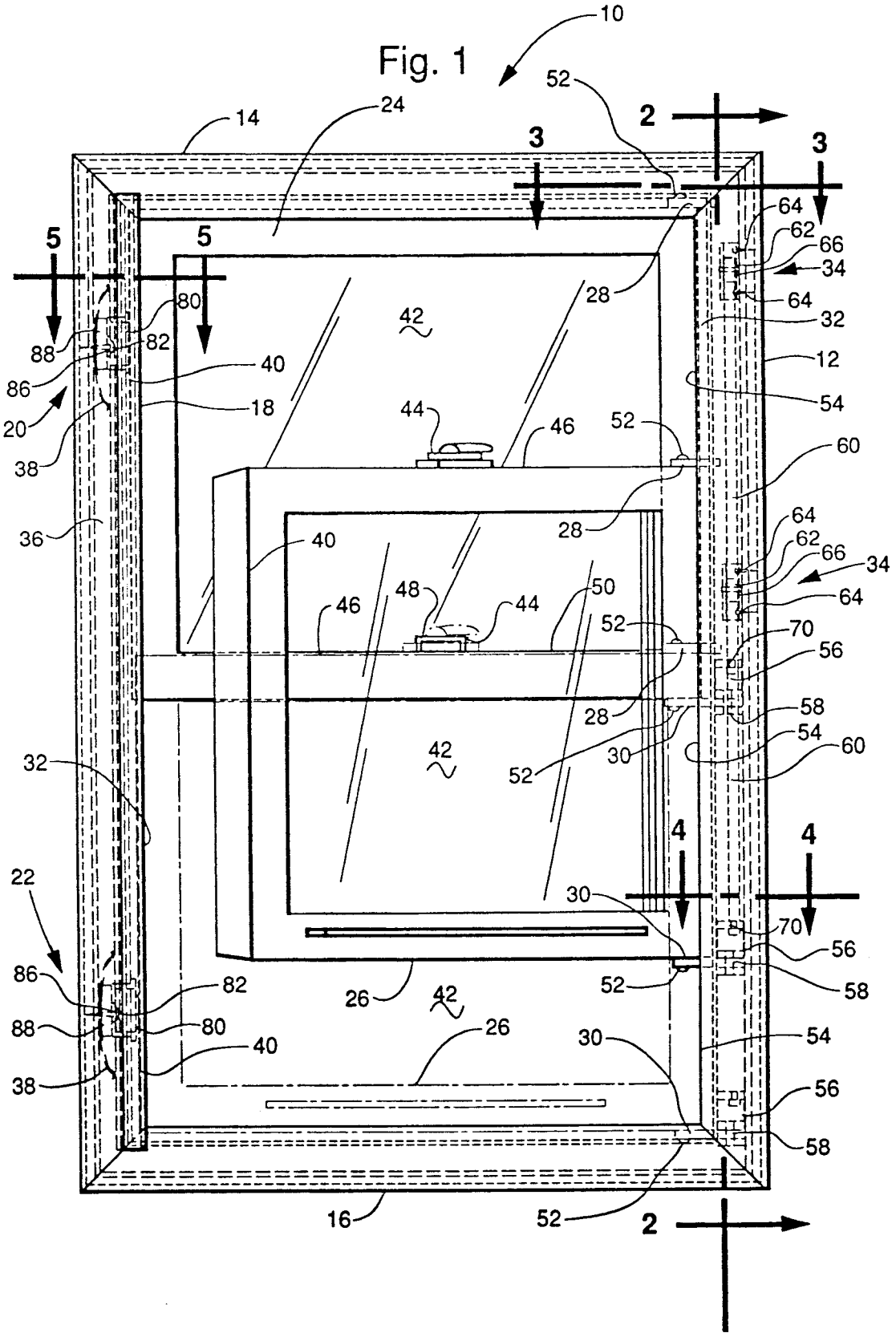
FIG. 1 is a front elevation view of an improved vertically slidable pivotal window unit embodying features of the present invention, with the lower sash thereof being shown in an exemplary vertically elevated and horizontally pivoted open position.

Referring to FIG. 1, the improved vertically slidable pivotal window unit 10 of present invention, and the cooperative component parts thereof comprising the same are shown in a front elevation view, which component parts consist of a frame having a fixed jamb 12 connecting an upper frame section 14 and a lower frame section 16 with a spring loaded jamb member 18 in turn having upper and lower spring loaded jamb latch assemblies respectively 20 and 22 which cooperate with said spring loaded jamb member 18 to latch or release for horizontally pivotal swinging upper and lower sash members respectively 24 and 26 each being pivotal about an upper and lower hinge member 28 and 30, wherein said upper and lower sashes 24 and 26 are also vertically displaceable slidably within sash guides 32 in said jambs 12 and 18 each of said sashes being controlled in vertically displaceable movement by a constant force counterbalance spring assembly 34.

Referring again to FIG. 1 to consider generally at this time the mechanically cooperative aspects of each of the above mentioned assemblies, and considering first among them the spring loaded jamb member 18.

The spring loaded jamb member 18 is horizontally moveable within the frame structure into the spring well channel 36 when manually pushed to effect deflective displacement of the leaf springs 38 and thereby release the free vertical edges 40 of the upper and lower sashes 24 and 26 for horizontally pivotal displacement inwards of the frame for purposes, of say, facilitating the ease and safety with which the panes 42 thereof may be cleaned. It will be noted, as illustrated in FIG. 1, the upper sash 24 is shown in the vertically and horizontally closed position and the lower sash 26 is shown in a vertically displaced and pivotally open horizontal position, with the upper and lower spring loaded jamb latch assemblies 20 and 22 being shown in the spring flexed lock position to effect latching of the upper sash member 24 against horizontal movement by securing the free vertical edge 40 therof within the sash guide 32 of the extended spring loaded jamb member 18.

As is typical with a double hung window assembly such as illustrated in FIG. 1, the window sashes are locked by securing the window locking latching cam assembly 44 affixed to the lower sash upper frame member 46 of the lower sash 26 rotatably within the latching cam keeper 48 affixed to the upper sash lower frame member 50 of the upper sash 24.

The upper and lower sash members 24 and 26 are slidably secured within the fixed jamb for vertical displacement and horizontally pivotal swinging by the upper and lower hinge members 28 and 30, which are affixed to and displaceable with the respective sashes 24 and 26 by means of pivot pins 52 to thereby utilize the secured vertical edges 54 of the respective sash members 24 and 26 in forming a single hinge stile structure for effecting the horizontally pivotal sash swinging capability. As is also shown in FIG. 1, the lower hinge member 30 of the respective sashes 24 and 26 is assembled to a counterbalance spring assembly connection block 56 by means of a connector rivet 58, whereby the spring coil ribbon 60 of the constant force counterbalance spring 62 is affixed to its respective sash 24 or 26 to effect a stabilized vertical displacement counterbalance control thereof.

As illustrated in FIG. 1, the improved vertically slidable pivotal window unit 10 is shown as a double hung window profile, which is to be considered as exemplary only for purposes of convenience in depiction and discussion. However, it will be apparent to those skilled in the art that a further number of sashes may be used in making a window embodying the instant features by simply alternating multiple vertical sashes from one jamb track to the other and modifying the sash locking hardware. Thus in public buildings such as schools, or in churches or the like, a plurality of sash members could be employed depending on the height of the frame and the size of the sash employed. Regardless of the window unit 10 sash profile, the frame members and sashes thereof are typically fabricated from either aluminum or plastic extrusions which are cut to the desired lengths for use in forming the frame and sash assemblies, although it is to be understood that any other suitable material or combinations thereof may be used.

Figure 2:
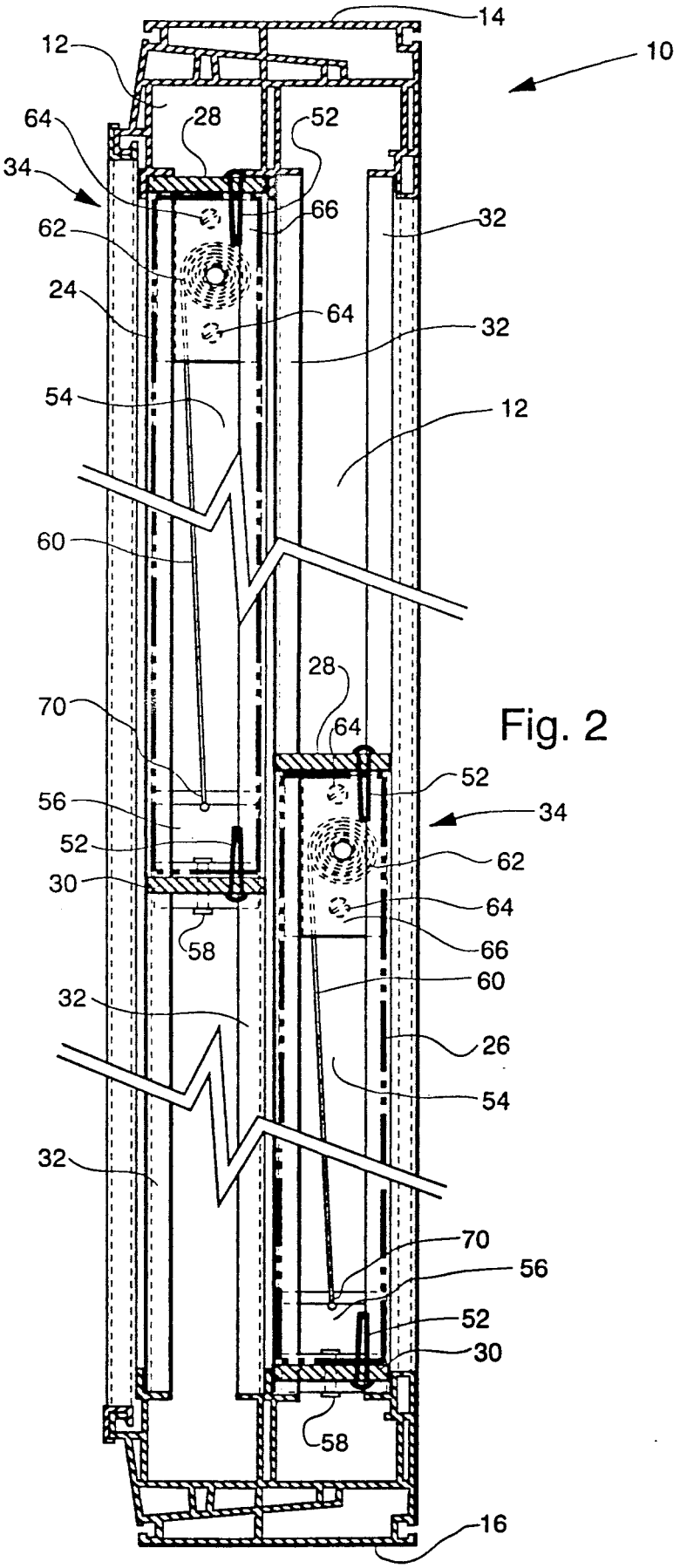
FIG. 2 is an enlarged side sectional elevation view of said window unit as shown in FIG. 1 and seen along the line 2—2 thereof, the same being foreshortened to accommodate the view to the sheet.

Referring now to the enlarged side sectional elevation view of the upper and lower window sash counterbalance spring assemblies 34 and the interconnecting blocks 56 as well as the upper and lower hinging hardware 28 and 30 therefor in further explaining utilization of the secured vertical edge 54 of the respective sash members 24 and 26 in forming a single hinge stile structure for effecting horizontally pivotal sash swinging capability, wherein for purposes of added ease in explanation the upper and lower sash members 24 and 26 are phantomed in the illustration of FIG. 2 to show more clearly their respective relative positions and structural relationships to the various hardware components presently being discussed. In the foregoing regard, assembly mechanics are accomplished first through a fixed connection of the constant force counterbalance springs 62 to the fixed jamb member 12 by means of spring mounting screws 64 insertably through openings in the spring base mounting plate 66 and threadably into screw bosses 68 provided in the fixed jamb 12 structure at positions which are located near the upper ends of the respective sashes 24 and 26 when in the closed vertically secured positions. Second, the spring coil ribbon 60 is extended and insertably engaged through a spring connection assembly slot 70 provided in the counterbalance spring assembly connection block 56, which block 56 as previously pointed out is fixedly assembled to the lower hinge member 30 by means of the connector rivet 58. Thus, the counterbalance spring 62 assembles from a fixed elevated position within the fixed jamb 12 by means of extending the coil ribbon 60 thereof to connect by way of the block 56 with the lower hinge member 30 corresponding to the respective sash therefor, which hinge member 30 is fixedly connected to the lower end of the subject sash by insertion of the pivot pin 52 therethrough and into the lower sash frame member along the secured vertical edge 54 thereof, so that when the subject sash is vertically displaced within the sash guides 32 both the spring coil ribbon 60 and the lower hinge member 30 with rivet connected block 56 displace therewith. Third, the upper hinge member 28 is fixedly connected to the upper end of the subject sash by insertion of its pivot pin 52 therethrough and into the upper sash frame member along the secured vertical edge 54 thereof so that it likewise moves with the subject sash cooperatively along with the lower hinge member 30 when the sash is vertically displaced. By this sash connection method, the horizontally pivotal displacement hardware therefor, being the upper and lower hinge members 28 and 30 move with the sash upon vertical displacement thereof, and the secured vertical edge 54 of the sash thereby structurally functions as a single hinge stile.

The views respectively shown in FIGS. 3 and 4 illustrate both the horizontal pivot profile capabilities of the upper and lower sash members 24 and 26 as therein seen in phantom, but more particularly they further illustrate the manner in which the upper and lower hinge member frame guide followers 72 and 74 operate to slidably engage the fixed jamb frame guide stiles 76 by means of recesses 78 to thereby effect retention and guidance of the sashes 24 and 26 for vertical displacement as well as frame disposed retention of both the upper and lower hinge members 28 and 30 upon horizontally pivotal displacement of said sashes 24 and 26.

Figure 5:
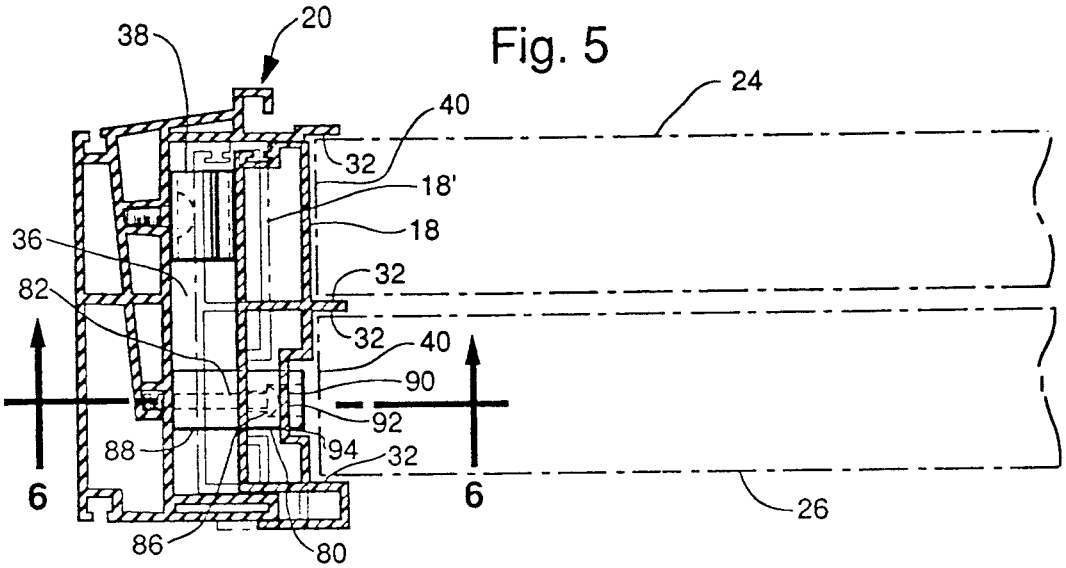
FIG. 5 is an enlarged top plan sectional view of the window unit assembly as shown in FIG. 1 and seen along the line 5—5 thereof.
Figure 6A:
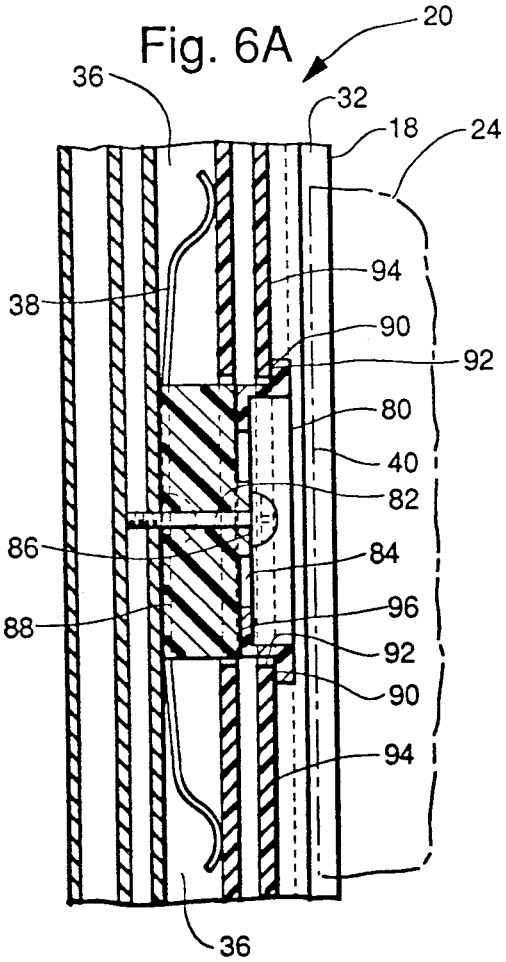
FIG. 6A is an enlarged side sectional elevation view of the jamb locking assembly in the sash locking profile as shown in FIG. 5 and seen along the line 6—6 thereof, the same being foreshortened to accommodate the view to the sheet.
Figure 6B:
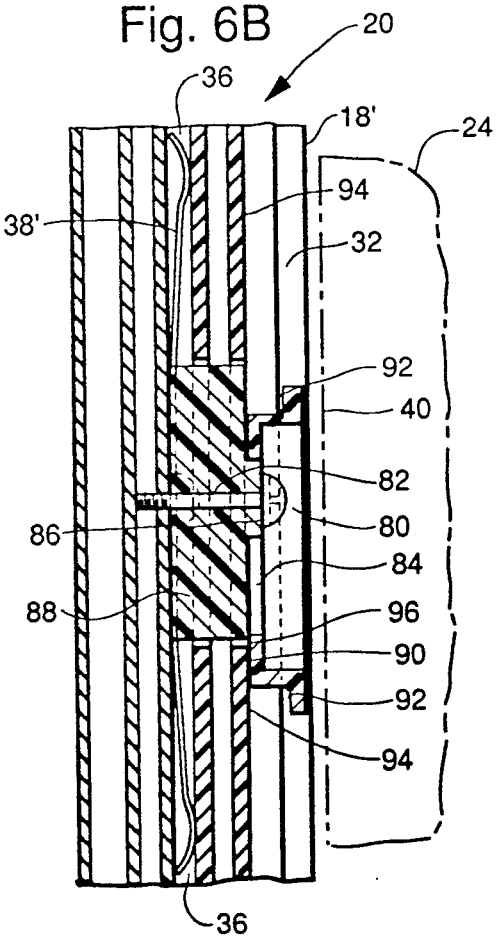
FIG. 6B is similar to that view as shown in FIG. 6A, but herein illustrating the jamb locking assembly in the sash release profile, also being foreshortened to accommodate the view to the sheet.

Turning now to a consideration of FIG. 5, which gives an enlarged top plan sectional view of the upper spring loaded jamb latch assembly 20 and showing the spring loaded jamb member in solid line rendition in the spring flexed lock position 18 and in phantom line rendition in the spring compressed release position 18', both of which profiles are further shown in enlarged side sectional elevation views respectively in FIGS. 6A and 6B to be herein also discussed in detail.

The jamb latch assemblies 20 and 22, whether upper or lower, are structurally and operationally identical and consist of the leaf spring 38 and the jamb latch and release keeper 80 that is retained in detent position within the jamb member 18 by means of a mounting screw 82 that insertably retains the latch and release keeper 80 through an elongated slot 84 therein by means of the screw head shoulder 86 overlie relationship to said slot 84 elongated opening. Also, in order that the latch and release keeper 80 may be suitably spaced for jamb latch and release operation it is backed by a spacer block 88, likewise being retained in operable position by insertable engagement thereof with said mounting screw 82 through an opening therein. When the leaf spring is in the flexed 38 position as shown in FIGS. 5 and 6A, it bears against the rear surface of the jamb member 18 and urges it forward so that the jamb retaining lip 90 is stoppably engaged by the keeper lip 92 when the keeper 80 is disposed in the detent position, which is the sash latching profile where the jamb 18 sash guides 32 are in an extended disposition to retain the sashes 24 and 26 in the vertical plane. When the spring loaded jamb member is displaced inward by appropriately applied manual pressure, as depicted in FIG. 5 by the spring loaded jamb member 18' being shown in phantom in the spring compressed release position, so that the face of the jamb trough 94 clears the rear keeper lip 96, as shown in FIG. 6B, then the keeper 80 gravity drops guided by the elongated slot following of the mounting screw 82 and being retained by overlie of the screw head shoulder 86 thereof so that the rear keeper lip 96 then engages the jamb retaining lip 90 and holds the spring loaded jamb member in the spring compressed release position 18'. To return the spring loaded jamb member to the spring flexed lock position 18, the keeper 80 is simply pushed upward until it snaps into the detent position when the compressed spring 18' then flexes and returns the jamb member to the lock position 18 as previously illustrated in FIG. 6A.

Although the improved vertically slidable pivotal window unit invention hereof, the structural features and method of utilization and the uses thereof have been shown and described in what is conceived to be the most practical and preferred embodiment, it is recognized that departures may be made respectively therefrom within the scope of the invention, which is not to be limited per se to those specific details as disclosed herein but is to be accorded the full scope of the claims so as to embrace any and all equivalent such units and devices.

We claim:

1. An improved vertically slidable pivotal window unit, said unit comprising in combination an enclosed rectangular frame, a plurality of window sashes mounted within said enclosed rectangular frame and adapted to be vertically displaceable therewithin, a plurality of constant force counterbalance spring means corresponding in number to the number of the plurality of said window sashes with one each thereof interconnected to the other within one vertical side of said rectangular frame, a spaced set of hinge members for each of said window sashes comprising said plurality each of said hinge members providing a complementary vertically projecting pivot pin respectively adapted to insertably engage inwardly from the upper and lower ends thereof a vertical frame member of each of said window sashes and being insertably connected thereto the same side thereof as interconnecting said constant force counterbalance spring means, a resilient depressable jamb member vertically mounted within said rectangular frame the interior vertical length thereof the side opposite said one vertical side thereof and being operable as a latch and release means to simultaneously secure said plurality of window sashes within said frame for vertical displacement or alternately simultaneously release said plurality of sashes said opposite one vertical side thereof respectively for horizontally pivotal displacement about said spaced set of hinge members the other one vertical side thereof, said latch and release means further comprising a vertically spaced set of jamb latch and release keeper means mounted to the frame member and gravity actuated to retain said jamb member in a retracted position to release said sash members for pivotal operation.

2. An improved vertically slidable pivotal window unit according to claim 1 wherein the number of the plurality of said sashes therein is two.

3. An improved vertically slidable pivotal window unit according to claim 1 wherein said constant force counterbalance spring means are respectively interconnected to said corresponding sash by assembly of an extended spring ribbon of said counterbalance spring means retainably within a slot of a counterbalance spring assembly connection block affixed to the lower end of said corresponding sash said same vertical side thereof as that of said counterbalance spring means connection within said frame.

4. An improved vertically slidable pivotal window unit according to claim 1 wherein said same vertical side of said plurality of said sashes respectively structurally function as a single hinge stile for connection of said spaced set of hinge members thereto.

5. An improved vertically slidable pivotal window unit according to claim 1 wherein said resiliently depressable jamb member is spring loaded.

* * * * *